US010843208B2

(12) United States Patent
Hatton

(10) Patent No.: US 10,843,208 B2
(45) Date of Patent: Nov. 24, 2020

(54) RAIN SHOWER SHOWERHEAD SYSTEM

(71) Applicant: Alexander Hatton, San Diego, CA (US)

(72) Inventor: Alexander Hatton, San Diego, CA (US)

( * ) Notice: Subject to any disclaimer, the term of this patent is extended or adjusted under 35 U.S.C. 154(b) by 65 days.

(21) Appl. No.: 16/153,558

(22) Filed: Oct. 5, 2018

(65) Prior Publication Data

US 2020/0108404 A1 Apr. 9, 2020

(51) Int. Cl.
*B05B 1/18* (2006.01)
*B05B 15/654* (2018.01)

(52) U.S. Cl.
CPC ..... *B05B 1/18* (2013.01); *B05B 15/654* (2018.02)

(58) Field of Classification Search
CPC ..... B05B 1/18
USPC ..... 4/615
See application file for complete search history.

(56) References Cited

U.S. PATENT DOCUMENTS 3,814,399 A 6/1974 Melreit
4,545,083 A 10/1985 Searson
4,836,668 A * 6/1989 Christianson ..... A47G 1/02 359/512
4,904,072 A * 2/1990 Christianson ..... G02B 7/1815 359/512
4,993,821 A * 2/1991 Christianson ..... A47G 1/02 359/512
5,032,015 A * 7/1991 Christianson ..... A47G 1/02 359/512
6,802,089 B2 * 10/2004 Cropelli ..... E03C 1/066 248/297.31
7,043,776 B1 * 5/2006 Wu ..... E03C 1/0408 4/601
7,766,291 B2 * 8/2010 Eilmus ..... E03C 1/06 248/222.11
D689,983 S * 9/2013 Wilson ..... D23/228
8,523,126 B2 * 9/2013 Garrels ..... A47K 17/022 211/105.1
9,200,651 B2 * 12/2015 Lin ..... A47K 3/281
D754,288 S * 4/2016 Bahler ..... D23/228
2006/0230520 A1 * 10/2006 Tsai ..... E03C 1/06 4/567
2015/0165451 A1 6/2015 Gopalan et al.

FOREIGN PATENT DOCUMENTS

CN 101954320 A 1/2011
WO 2011069429 A1 6/2011

OTHER PUBLICATIONS

International Search Report and Written Opinion dated Dec. 12, 2019 for International Patent Application No. PCT/US2019/054835 filed Oct. 4, 2019. (7 pages).

* cited by examiner

*Primary Examiner* — Lori L Baker
(74) *Attorney, Agent, or Firm* — Perkins Coie LLP

(57) ABSTRACT

A showerhead assembly for dispersing liquid, comprising a back part; a front part coupled to the back part to form a plurality of dispersion chambers; an inlet boss disposed between the front part and back part for connecting a liquid supply line; a liquid supply, rail disposed between the front part and the back part and connected to the inlet boss for leading liquid to the dispersion chambers; and a plurality of support members slidably coupled to the front part such that the support members can slide between the front part and the back part.

26 Claims, 18 Drawing Sheets

RAIN SHOWER SHOWERHEAD SYSTEM

TECHNICAL FIELD

The subject matter disclosed herein relates to a rain shower showerhead system.

BACKGROUND

Consumers enjoy a luxurious shower bathing experience. In recent years, the rain shower showerhead (also known as rain heads) has become extremely popular as an adjunct water delivery system within residential shower enclosures. Existing rain heads tend to be larger and wider than standard shower heads and, instead of spraying concentrated streams of water, they shower the occupant of the shower space more gently from a position directly above them. However, because of their larger size and increased moments of inertia, these devices require additional and specialized mounting hardware. They are also prohibitively expensive or require professional installation. Consumers who reside in rental properties are often forbidden from making necessary modifications to install the existing rain heads. The existing rain heads also do not allow relocating as lacking the adaptability to various types, sizes and shapes of shower spaces and enclosures.

Overhead rain heads are universally installed with a supply pipe plumbed into them. Consumer installed models that replace or combine with an existing supply pipe and showerhead are positioned to the side of the shower occupant and project water at an angle greater than twenty degrees from vertical toward the user using jets or nozzles. Mechanisms that extend standard showerheads above the shower occupant do not adapt to various types, sizes and shapes of shower spaces and enclosures. They also do not support larger rain heads and are made from non-recyclable combinations of materials. All of these rain heads are not easily installed, removed, and re-installed.

The desire to experience bathing in natural rain drives the popularity of the rain head style showerhead. However, the existing rain heads do not address the aesthetic acoustics of the rain shower experience such as multi-modal acoustic patterns. Nor do they incorporate multiple physical water textures or varied water droplet sizes.

Many consumers would also enjoy and benefit from having a video display present during their shower bath experience. Currently, no shower system on the market provides this functionality.

SUMMARY

The rain shower showerhead (also known as "rain head") system disclosed herein features a flat, rectangular shape and a number of support members that expand independently to connect to various surfaces (e.g., parallel and perpendicular or otherwise angled or curved surfaces) of various shower spaces (e.g., a residential, commercial, industrial or marine shower spaces). The support members are configured to safely suspend and support the showerhead in a position directly above the shower occupant. The support members are also configured to position the shower head at variable heights above the shower occupant, including but not limited to positions at or near the ceiling of the shower space. The support members are further configured to connect and support accessories, such as misting nozzles, video displays, portable storage caddies, soap dispensers, a shower curtain and the liquid supply line support.

The support members allow the showerhead to be easily installed, removed, and re-installed in a shower space, whether of similar or differing geometry and dimensions. Modification to plumbing or significant repairs to property is thus not needed when installing or removing such a showerhead.

The showerhead system disclosed herein is connected to a liquid supply to produce a simulation of rainfall with accompanying acoustic effects, by internally reducing supply pressure to atmospheric pressure and then dispersing the supplied liquid through a grating. In some embodiments. the showerhead system is made of a recyclable material and can be recycled at the end of product life.

The showerhead system disclosed herein is suitable for home owners and landlords who did not have rain shower showerheads installed at the time of construction, as well as the renters of such properties. Hoteliers can update existing properties with this showerhead system at minimal cost, because it does not require licensure for installation and the product is designed to reduce packaging and manufacturing costs.

The expanding supports of the showerhead system disclosed herein can span the width of various shower spaces, including, for example, a full-size shower enclosure, a shower stall or a corner shower stall. The expanding supports can also fit in a retail package that is easily displayed and stored on typical aisle shelves. Further, the showerhead system disclosed herein includes more utility than state of the art products and can be produced at a significantly lower cost.

The expanding supports disclosed herein support a variety of accessories, including video display carriers. In some embodiments, a video display carrier for receiving a variety of video tablets is slidably attached to and supported on the expanding supports. In some embodiments, a water-proof, clear plastic sleeve that fits inside the video display carrier is provided to protect the tablet. Consumers may use their existing wireless communications tablets to stream live news or entertainment broadcasts into the shower space, increasing the luxury and enjoyment of their shower bath experience.

The showerhead system disclosed herein also features integrated or accessory shower curtain supports for holding an adjunct shower curtain. The adjunct shower curtain allows consumers to position the showerhead system at heights above their existing shower curtain or shower door to prevent spraying into the area outside the shower space.

In some embodiments, liquid exits the dispersion chambers at atmospheric pressure. Surface tension allows some of the liquid to run across the surface of the showerhead and drop in random patterns into the shower space. Misting accessories allow the consumer to position misting nozzles along and around the expanding supports, thereby filling the shower space with a fine mist. These features produce varying liquid textures within the shower space.

The showerhead system disclosed herein can be used by consumers for a luxurious ultra-realistic rain shower experience. It can also be used to shower a physical object. It can be used in any appropriate shower space, with or without enclosure. While the preferred embodiments are injection molded, a machined product may be produced from existing design files to meet specific customer requirements for liquid processes. For instance, the showerhead system disclosed herein can be machined from a single billet of plastic, aluminum or other homogeneous material to accommodate volatile and/or exotic liquids.

The showerhead system disclosed herein delivers highly desirable utility to the consumer, including the following exemplary features: placing directly above the shower occupant in any appropriate shower space; producing random and varied water droplet sizes; producing a fine spray mist that covers the entire shower space; producing a variety of aesthetically pleasing rain shower acoustic effects; and housing video entertainment appliances all in a system. Moreover, it can be easily installed, post-construction, and can be removed with minimum effort or damage to the shower space and the system itself. Further, it can be installed at any height above the shower occupant, up to and including heights at or near the ceiling of the shower space.

BRIEF DESCRIPTION OF THE DRAWINGS

For a complete understanding of the invention, reference is made to the following detailed description and accompanying drawings illustrating various features of the embodiments.

DETAILED DESCRIPTION

Figure 1:
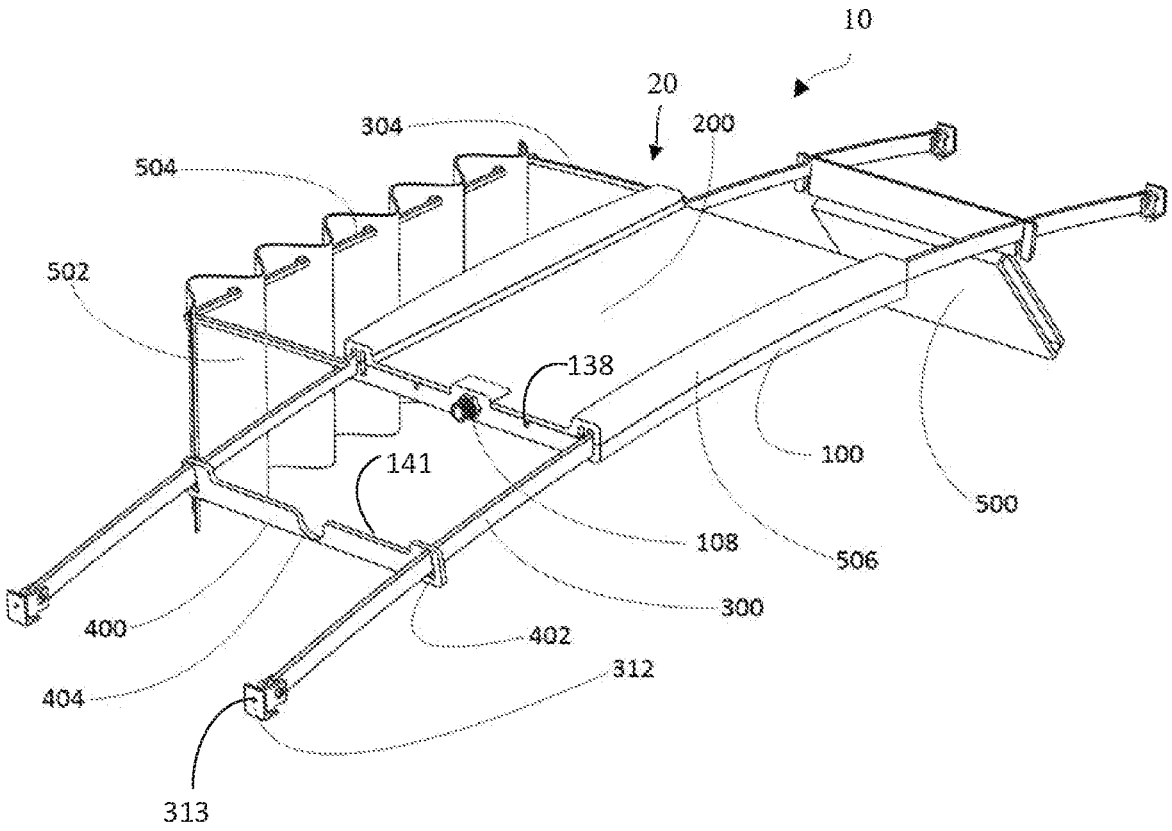
FIG. 1 is an exemplary perspective view of the expanded showerhead shower system taken from above.

While this document contains many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiting that such operations be performed in the particular order shown or in sequential order, or that all illustrated operations be performed, to achieve desirable results. Only a few examples and implementations are disclosed. Variations, modifications, and enhancements to the described examples and implementations and other implementations can be made based on what is disclosed.

In reference to FIG. 1, the showerhead system 10 disclosed herein is primarily comprised of four parts: the front part 100, the back part 200, the expandable support members 300, and the liquid supply line support 400. The front part 100 and the back part 200 are joined to form the showerhead 20.

Figure 2:
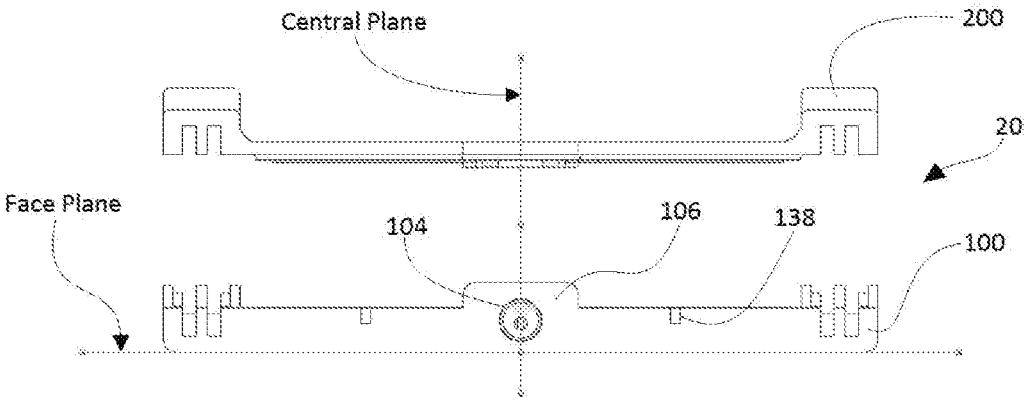
FIG. 2 is an exemplary cross-sectional view of the front part and the back part.
Figure 3:
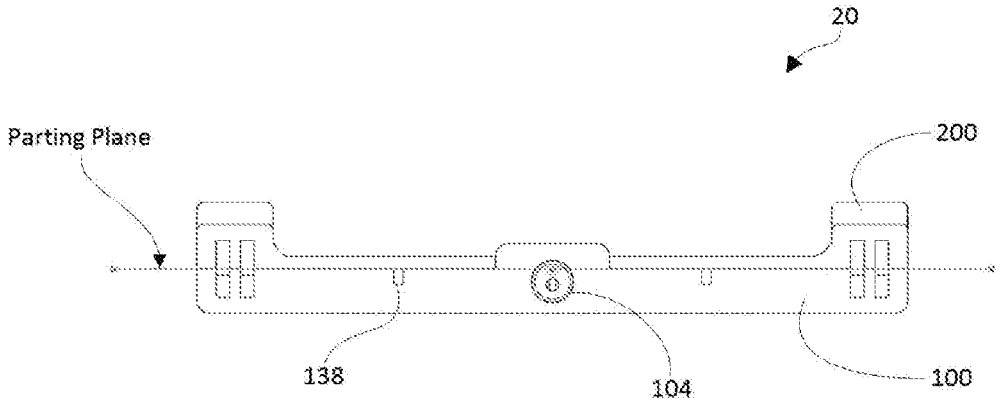
FIG. 3 is an exemplary cross-sectional view of the assembled front part and back part.

The Front Part 100:

For easier reference, the following description defines four geometric planes: In reference to FIG. 2, Face Plane is a geometric plane coincident with the surface of the front part 100 of the showerhead 20. Face Plane is nearest the shower occupant and bearing the ornamental design of liquid outlets. In reference to FIG. 3, Parting Plane is a geometric plane parallel to the Face Plane and coincident with the union of the front part 100 and back part 200 of the showerhead 20. In reference to FIG. 2, Central Plane is a geometric plane perpendicular to the Face Plane and bisecting the showerhead 20 down its long axis, collinear with the axis of the liquid supply inlet 104. In reference to FIG. 4, Edge Plane is a plane perpendicular to both the Parting Plane and Central Plane, and coincident with the outer surface of the showerhead 20 bearing the liquid inlet 104.

Figure 5:
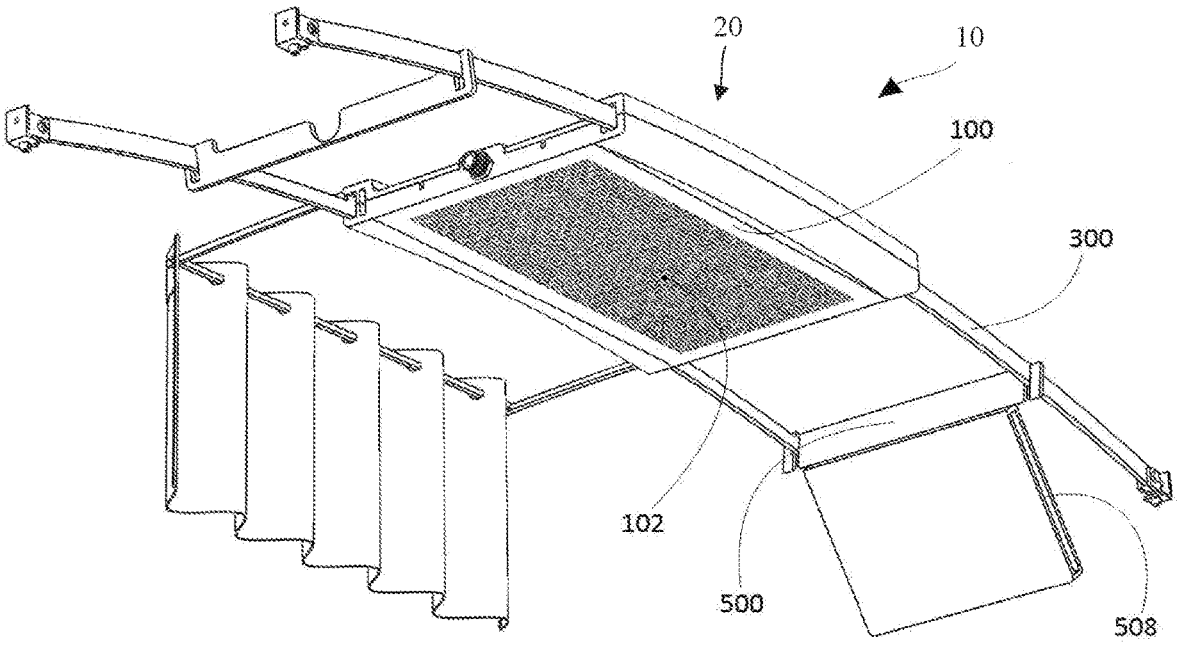
FIG. 5 is an exemplary perspective view of the expanded showerhead shower system taken from below, specifically showing the ornamental design of the front part.

The overall shape of the showerhead 20 disclosed herein is flat and rectangular. The face of the showerhead 20 is coincident with the Face Plane, and bears an ornamental design of the dispersion grating 102, as shown in FIG. 5.

Figure 7:
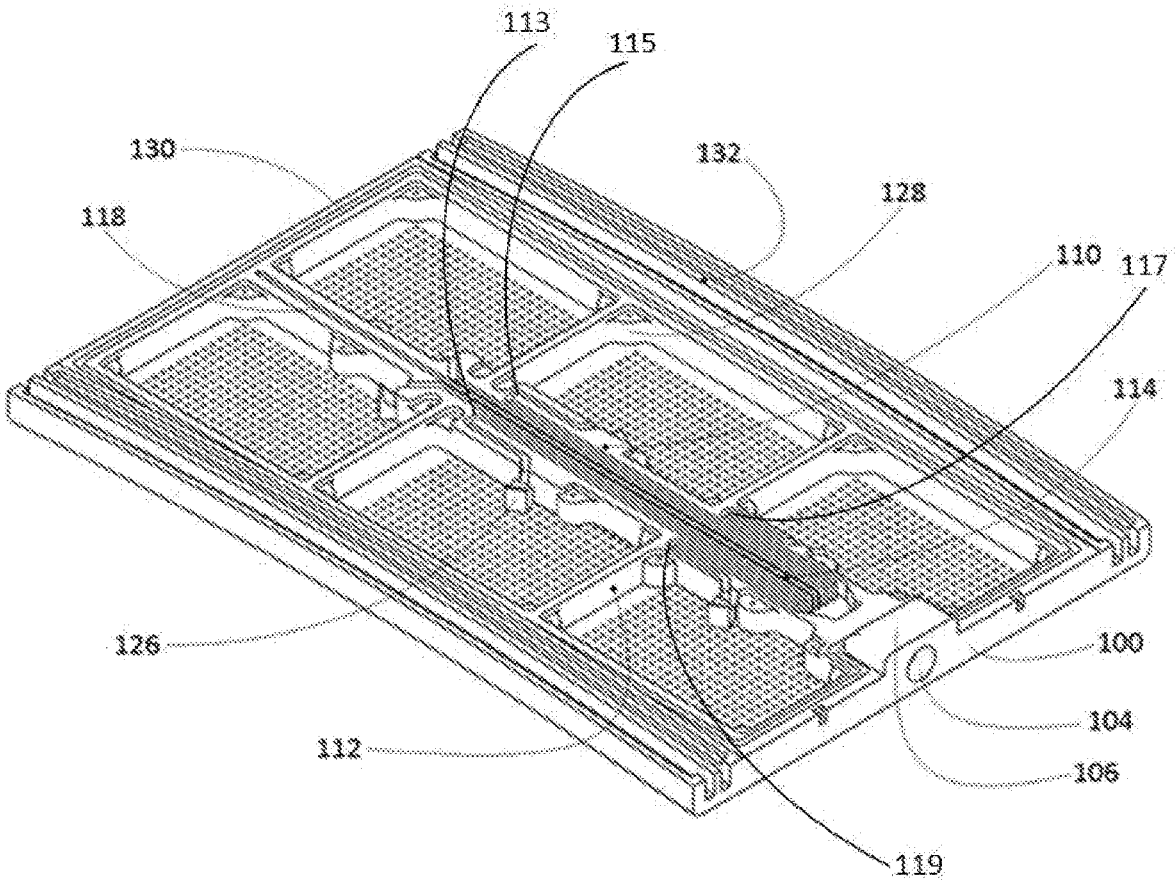
FIG. 7 is an exemplary perspective view of the front part, showing inner features of the showerhead.
Figure 18:
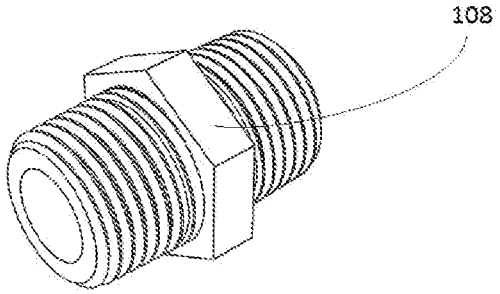
FIG. 18 is an exemplary perspective view of a threaded adapter for connecting to the liquid inlet.

In reference to FIG. 7, a threaded, cylindrical liquid inlet 104 allows liquid from a supply line to enter the showerhead 20. The inlet 104 is formed into the front part 100 of the showerhead 20 on the inlet boss 106. The inlet 104 may receive a threaded adapter, typically ½" Male NPT type 108, as shown in FIG. 18, or include such threaded features to allow attachment of a liquid supply line. The inlet 104 may also utilize other technologies, such as quick-connect fittings, to attach to a liquid supply line, as determined by one of ordinary skill in the art.

The inlet boss 106 is a projection of the front part 100 extending above the Parting Plane. The circle transcribing the beginning diameter of the cylindrical liquid inlet 104 lies on the surface of the Edge Plane and pierces both the Face Plane and the Central Plane. The axis of the liquid inlet 104 lies on the Central Plane and parallel to the Parting Plane, entering horizontally and allowing installation of the showerhead 20 at any height above the shower space to a maximum height flush or nearly flush against the ceiling.

Internally, the liquid inlet 104 connects to a central liquid supply rail 110, which supplies one or more atmospheric pressure dispersion chambers 112. Each chamber 112 is supplied by one or more liquid supply channels 114 in the liquid supply rail 110. The specific dimensions of the liquid supply channels 114 are easily calculable by one of ordinary skill in the art to supply appropriate rates of flow to the chambers 112.

Figure 4:
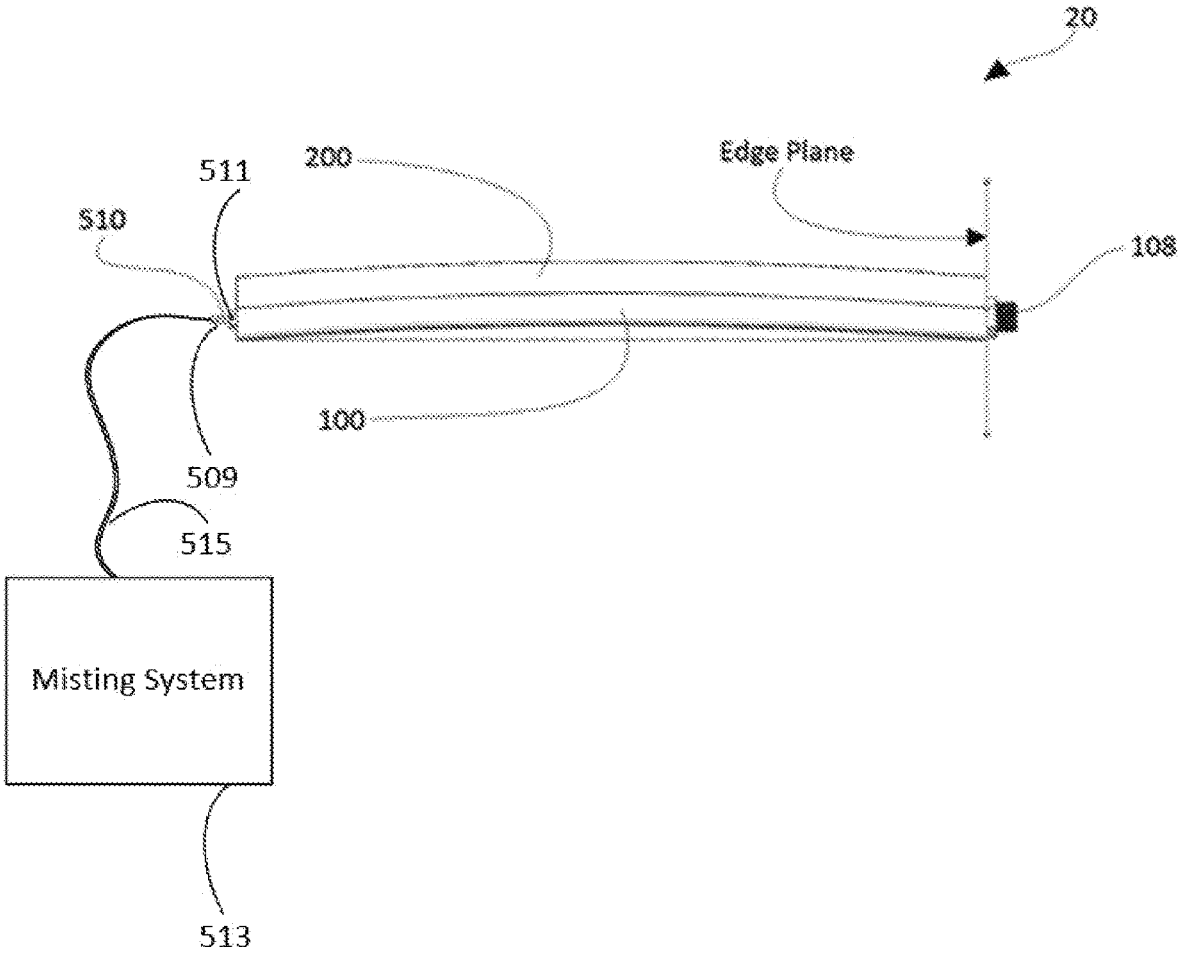
FIG. 4 is an exemplary side view of the assembled front part and back part.

For embodiments that include a misting accessory, the liquid supply rail 110 further supplies the external misting accessory 513. In some embodiments, the misting system 513 attaches to the showerhead 20 by means of a threaded, cylindrical liquid outlet 510 on the far side of the showerhead 20 opposite the liquid inlet 104. As shown in FIG. 4, the liquid outlet 510 includes a threaded adapter 511 and barbed hose fitting 509 for the misting accessory 513. The dimensions of the liquid outlet 510 can be determined by one of ordinary skill in the art to make sure they fit commercially available misting accessories. Liquid is supplied from the inlet 104 to the liquid outlet 510 by means of an additional liquid supply channel or channels 118. The tubing, fittings, connectors and mist nozzles are readily available on the commercial market. For embodiments without the external misting accessory, the liquid outlet may be closed off by means of a threaded plug or by eliminating the additional channel or channels 118 from the liquid supply rail 110.

Figure 8:
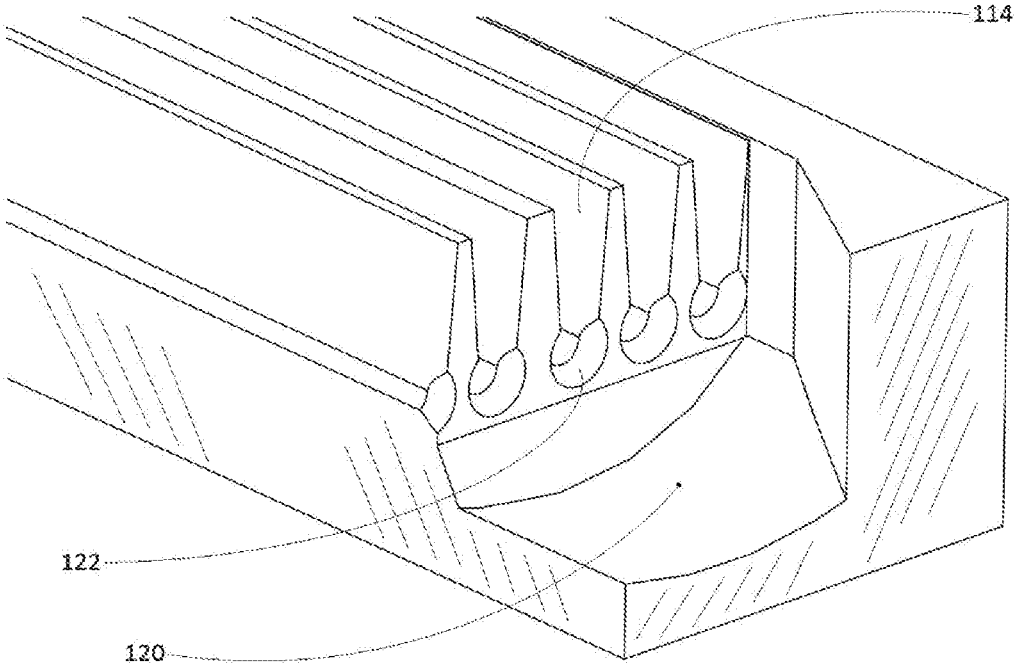
FIG. 8 is an exemplary sectional view of the front part, showing the diffuser, the drafts and tapered openings of the liquid supply channels.

In some embodiments, the showerhead 20 includes six atmospheric pressure dispersion chambers 112, with three oriented on each side of the Central Plane. Liquid flows from the liquid supply along the liquid supply line, through the liquid inlet 104 into the central liquid supply rail 110. The flow is there divided into six channels by means of a diffuser 120, as shown in FIG. 8. The inclusion of diffuser 120 in the path minimizes losses from turbulence and pressure is recovered downstream. The bottom of the diffuser 120 and top of the corresponding cover in the back part 202 are rounded, or "dished," to form an approximately elliptical cross section, as shown in FIG. 8, which improves laminar flow.

Figure 10:
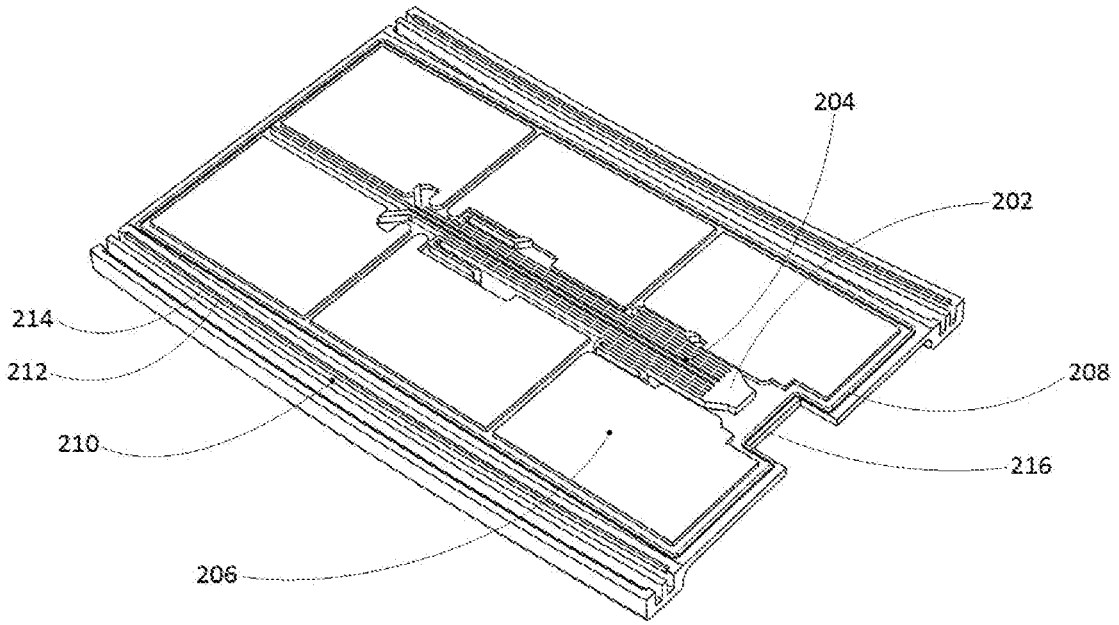
FIG. 10 is an exemplary perspective view of the back part.

In reference to FIG. 8, the six channels 114 have rounded bottoms that, when joined with the rounded channel covers of the back part 204, form approximately round pipes. The walls of the six channels 114 are drafted outward from the direction of the Face Plane toward the Parting Plane such that they fit flat against the drafted edges of the channel covers 204, as shown in FIG. 10. The tolerance on this fit should provide some interference to insure opposite surfaces are in contact when pressed together in assembly. This seals the pipes, eases assembly and minimizes frictional losses in the pipes due to the presence of a seam edge.

In reference to FIG. 8, the openings of each of the six pipes 122 are tapered inward from the diffuser 120 to the inside diameter of the pipes. This minimizes turbulent losses and aids pressure recovery. Corners and sharp edges within the diffuser 120 and liquid supply rail 110 should be broken where appropriate to improve laminar flow.

The continuity equation for multi-flow paths of incompressible fluids holds that the sum of the flows in is equal to the sum of the flows out of the system, written mathematically as:

$$\Sigma Q_{in} = \Sigma Q_{out} \quad \text{(Eq. 1)}$$

where Q is the volumetric flow rate expressed in units of volume per unit time.

While there are no regulations or laws governing showerhead flow rates, the shower bath industry has selected a flow rate of 2.5 gallons per minute (gpm) as an environmentally responsible limit for showerheads. The showerhead system 10 is both a shower head and a shower system and thus may be embodied to exceed this limit when operated with misting or other accessories, if desired.

Most commercially available shower hoses are designed to deliver no more than 2.5 gpm of liquid supply at residential pressures. From (Eq. 1), using a commercially available shower hose with the present invention will typically result in no more than 2.5 gpm of liquid dispensed to the shower occupant.

Bernoulli's Principle states that an increase in the speed of fluid flow occurs with a simultaneous decrease in pressure or decrease in potential energy of the fluid. For a steady flow of a homogeneous, incompressible fluid with negligible viscous friction, a simple form of the Bernoulli Equation is given thusly, $$\frac{v^2}{2} + gz + \frac{p}{\rho} = \text{constant}, \quad \text{(Eq. 2)}$$

where v is speed of fluid flow, g is acceleration due to gravity, z is elevation referenced to a plane and sensed opposite g, p is pressure, and p is homogenous density.

From this, the fluid velocity and pressure at any point along a particular path in a multipath system of steady fluid flow will be equal to the velocity and pressure at a symmetric point along an equal, symmetrical path. To balance flow at multiple outlets of the liquid supply rail, the cross-sectional area and the length of each of the pipes should be approximately equal. Because the six dispersion chambers 112 are not equidistant from the liquid inlet 104, the equal path lengths of the liquid supply channels 114 are achieved by featuring turns 113, 115, 117, 119 in the pipe routing of the liquid supply channels 114 to the four dispersion chambers 112 closer to the liquid inlet. However, the necessary turns 113, 115, 117, 119 in the pipe routes of the liquid supply channels 114 introduce asymmetrical frictional and turbulent loss. As the fluid passes through straight sections beyond these turns, much of this loss is recovered. In one embodiment shown in FIG. 7, the turns are 180 degree changes in direction of the channels (and thus the flow of water as it flows through of the liquid supply channels 114) to dispersion chambers 112.

The calculations to balance flows between multiple asymmetric paths are complicated. In such cases, computer aided design software featuring finite element analysis programming provides accurate predictions of flow rates. One of ordinary skill in the art may take advantage of this design process to choose appropriate pipe sizes and routes for the chosen materials to achieve desired flow rates to each of the dispersion chambers.

Figure 9:
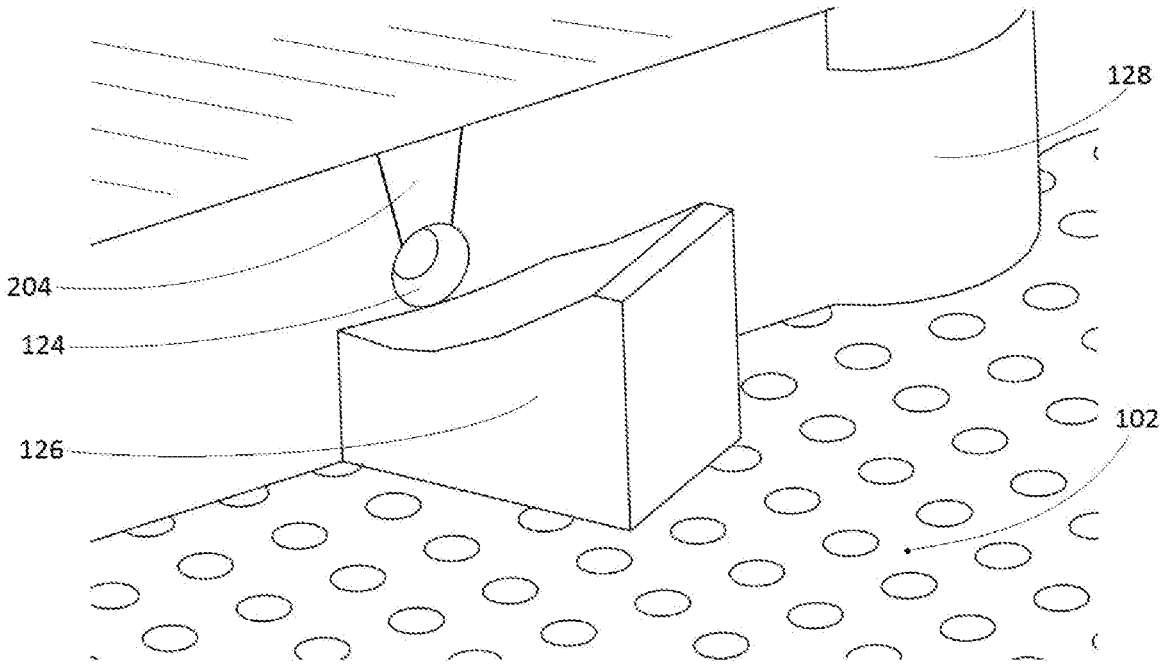
FIG. 9 is an exemplary sectional view of the assembled front and back parts, showing the tapered pipe and dispersion boss (deflector) at the entrance to the atmospheric pressure dispersion chambers inside the showerhead.

In reference to FIG. 9, the inside diameter of the straight sections of pipe leading immediately into the dispersion chambers 112 may be slightly tapered inward to increase fluid velocity as it approaches the tapered outlet 124 at the wall of the chamber 112, to form a jet as the liquid enters the chamber 112.

As liquid enters a dispersion chamber 112, it impinges on a dispersion boss 126, also called a deflector. A deflector is a geometric feature that lies in the path of the liquid flow and alters that path when the liquid impinges on its surface. Altering the path of the liquid in this manner improves liquid dispersion across the chamber 112. The shape of the dispersion boss 126 also affects the sound produced by the showerhead. Within these chambers 112, the liquid pressure reduces to atmospheric pressure. The inside surface of the dispersion grating 102 is graded toward the liquid supply rail 110 to allow liquid projected across the chamber 112 to run back across the grating 102. Dispersion holes along the seam between the liquid supply rail 110 and the grating 102 ensure liquid does not pool in the chamber 112. The liquid disperses through the grating 102 and is delivered to the shower occupant, or other targets.

Some embodiments use wide-angle, flat fan pattern dispersion bosses 126 to deflect the flow of liquid in a fan shape, upward to impinge on the chamber covers 206 of the back part 200. The dispersion bosses 126, in conjunction with the tapered outlet 124, forms a wide angle flat fan (FF) nozzle. The liquid then falls into the chamber 112 due to gravity or flows along the top and around the sides of the chamber 112 by surface tension and inertia, ultimately flowing over the dispersion grating 102 and falling onto the occupant of the shower space below.

The holes of the dispersion grating 102 may be of various sizes to simulate natural rain. The pattern may be modified by one of ordinary skill in the art to effect different aesthetic patterns of falling water.

In reference to FIG. 9, protrusions called joining bosses 128, which extend from the inner surface of the chambers 112, provide a substrate to receive fasteners from the back part 200, to receive adhesive between the parts, to receive a combination of fasteners and adhesive, or to receive application of other chemical, mechanical or magnetic fastening parts and/or materials serving to join the front part 100 and the back part 200. In some embodiments, either screw-type fasteners or snap-fit cantilever features may be used that allow joining of the front part 100 and back part 200 without tools or fasteners. The locations of the joining bosses 128 are easily calculated by one of ordinary skill in the art such that, when joined with the back part 200, they provide resistance to the force of pressure exerted by the liquid supplied to the showerhead 20 sufficient to maintain the union between the front part 100 and back part 200.

In reference to FIG. 7, a groove 130 in the surface of the front part 100 coincident with the Parting Plane circumscribes the atmospheric pressure dispersion chambers 112. The path of the groove 130 passes among the chambers 112 and the inlet boss 106. The groove 130 accepts an approximately half-round profile protrusion called ridge seal 208 from the inner surface of the back part 200, as shown in FIG. 10. When joined, the groove 130 and ridge seal 208 act in similar fashion to a groove and gland seal. Because the chambers 112 operate at atmospheric pressure, compressible glands are not necessary to seal the seams between the front part 100 and the back part 200.

In reference to FIG. 7, four L-shaped pockets 132 are formed into the surface of the front part 100 coincident with the Parting Plane, two on each side of and running parallel to the Central Plane. Two pockets 132 on the same side of the Central Plane constitute a pair of pockets 132. In reference to FIG. 11, each pair of pockets 132 is a mirror of the other pair, about the Central Plane. All four L-profiles are oriented such that one leg, the travel stop track 134, lies parallel and coplanar to the Parting Plane. The travel stop tracks 134 do not extend all the way through to the outer surface on any side of the front part. The other leg of the L-profile, the support slide track 136, lies parallel to the Central Plane and extends down from the Parting Plane toward the Face Plane for a distance at least to accommodate one-half of the largest vertical dimension of the expandable support members 300, plus a tolerance for fit set by one of ordinary skill in the art. The support slide tracks 136 extend all the way through the outer surfaces of the showerhead 20.

Figure 6:
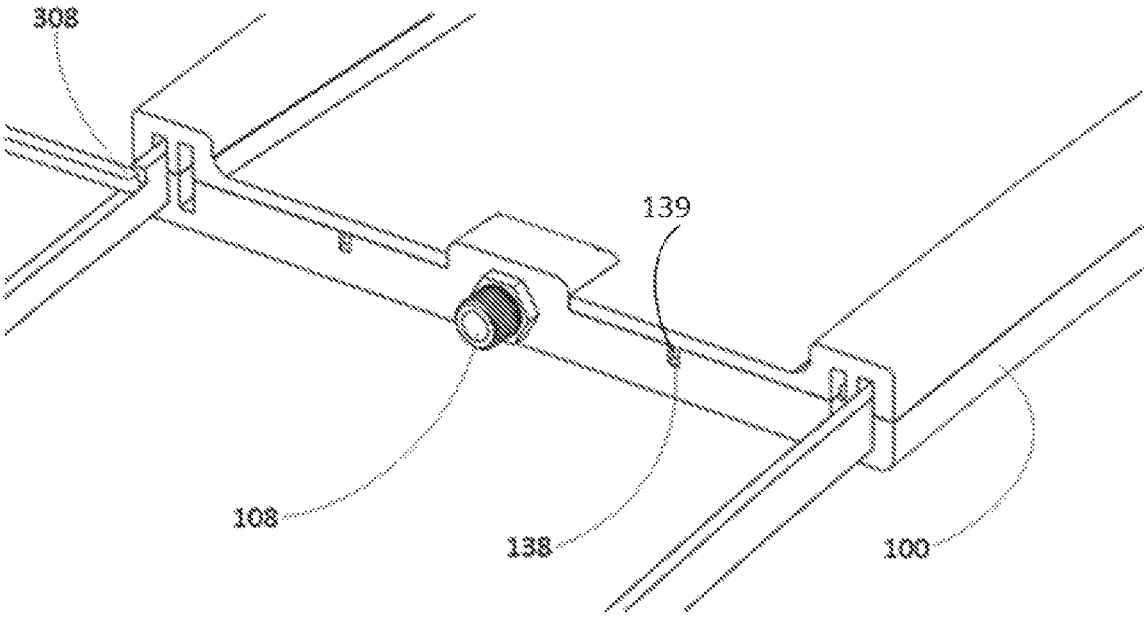
FIG. 6 is an exemplary view of a side of the showerhead where the liquid inlet is located.

In reference to FIG. 6, two snap-fit receiving pockets 138 on the inlet 104 side of the front part 100 allow snap-fit cantilever features 141 (not shown in FIG. 6, see 1) of the liquid supply line support 400 to hold the support 400 in place against the front part 100. These receiving pockets 138 have a draft angle 139 sufficient to allow the snap-fit cantilever 141 to release deflection upon full insertion, but do not have a hard overhang that captures the cantilever 141. This allows the cantilever 141 to withdraw. When installed, the liquid supply line support 400 is released from the receiving pockets 138 by pulling it away from the front part 100.

The Back Part 200:

In reference to FIG. 10, the back part 200 of the showerhead system 10 disclosed herein is approximately a thin rectangular plate. Protrusions from the back piece extend below the Parting Plane and act to cover and seal the liquid supply channels 114 of the central liquid supply rail 110, the atmospheric pressure dispersion chambers 112, and the approximately half-round groove 130 that circumscribes the dispersion chambers 112. The dimensions of these features are set by one of ordinary skill in the art such that they sufficiently seal their counterparts and there is sufficient tolerance and taper, also called draft angle, for ease of manufacturing and assembly. The ridge seal 208 may be replaced by an axial-face sealing gland, if desired. Pockets above the Parting Plane act to contain the expandable support members 300 and constrain their movement within the showerhead 20.

Some embodiments include six chamber covers 206 protruding from the inner surface of the back part 200, with three oriented on each side of the Central Plane. Each chamber cover 206 acts to seal a corresponding chamber 112 directly below it. In applications where fasteners are used to join the back part 200 and front part 100, pilot holes are formed in the chamber covers 206; for embodiments using snap-fit cantilever features, those features extend proudly from the surfaces of the chamber covers 206 to meet and join with corresponding receiving pockets in the joining bosses 128 of the front part 100. (Cantilever fastening requires additional machining operations or molding tools to create notches in such receiving pockets to lock the fasteners in place.) The locations of these pilot holes or receiving pockets are easily calculated by one of ordinary skill in the art to correspond to and align with the locations of the joining bosses 128 on the front part 100.

The dimensions of the L-shaped pockets 210 in the back part 200 and the front part 100 are mirrored about the Parting Plane. When assembled, the four L-shaped pockets 132 of the front 100 and four L-shaped pockets 210 of the back part 200 combine to form four, T-shaped pockets, where the pocket formed by the travel stop tracks 134 and 212 do not extend all the way through to the outer surface of the showerhead 20. The pockets formed by the support slide tracks 136 and 214 extend through the surface of the showerhead 20.

The liquid supply channel covers 204 extend below the Parting Plane into the liquid supply channels 114, thus forming approximately round pipes for liquid to flow through. The sides of these covers 204 are tapered, or drafted, to ease joining with the front part. The specific dimensions of these covers, including the depth they extend into the channel 114 below, are easily calculable by one of ordinary skill in the art to supply desired rates of liquid flow to the chambers 112 and misting system and maintain a seal between the front part 100 and the back part 200.

The channel covers 204 in some embodiments are rounded, concave upward away from the bottom of the liquid supply channels 114 of the front part 100, such that when joined with the front part 100, they form approximately round pipes. A section of the liquid supply channel cover 204 also covers the diffuser 120. This portion of the channel cover 204 is rounded, or "dished," concave upward away from the bottom of the diffuser 120 to form the diffuser cover 202, such that when joined with the front part 100, it forms an approximately elliptical cross-section.

The notch 216 in the rectangular profile of the back part 200 allows the back part 200 to fit against the inlet boss 106 on three sides, achieving a seal of the seam between the front part 100 and the back part 200, near the pressurized supply inlet 104.

The Expandable Support Members 300:

A number of expandable support members 300 connect to the walls and/or ceiling of the shower space and act to suspend and support the showerhead 20 in a position directly above the shower occupant. Some embodiments use four expandable support members 300 to connect to the walls of the shower space, acting to suspend and support the showerhead 20 in position above the shower occupant. The overall shape of the support members 300 is an arched rectangular bar, curved the "hard way." The support members 300 have geometric features at both ends of the bar to effect connection with the showerhead 20 and to connect fittings that mount the showerhead 20 to supporting surfaces of the shower space. The support members 300 may have one or more accessory notches 302, as shown in FIG. 13, to receive and positively locate the liquid supply line support 400, video display carriers 500, portable storage caddies and/or other accessories.

Figure 13:
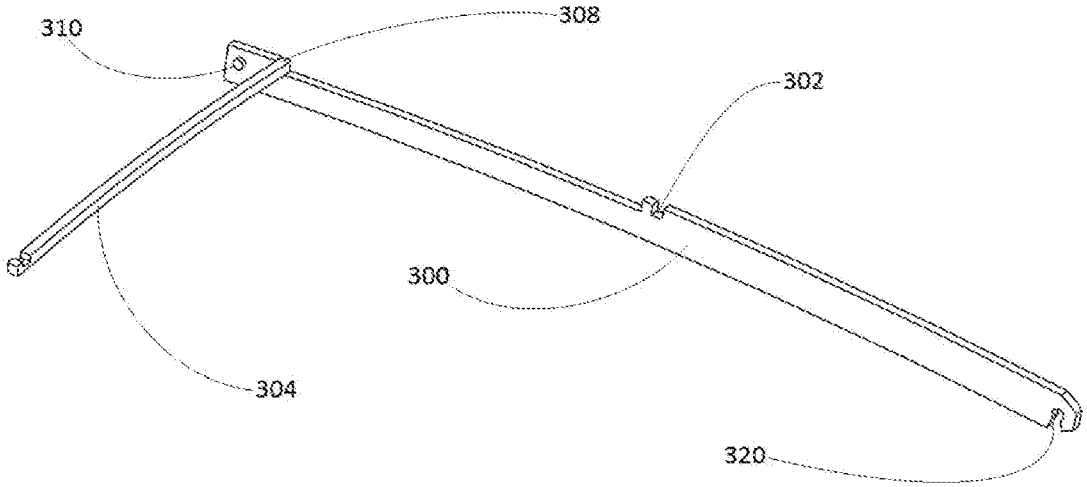
FIG. 13 is an exemplary perspective view of one expandable support member.
Figure 14:
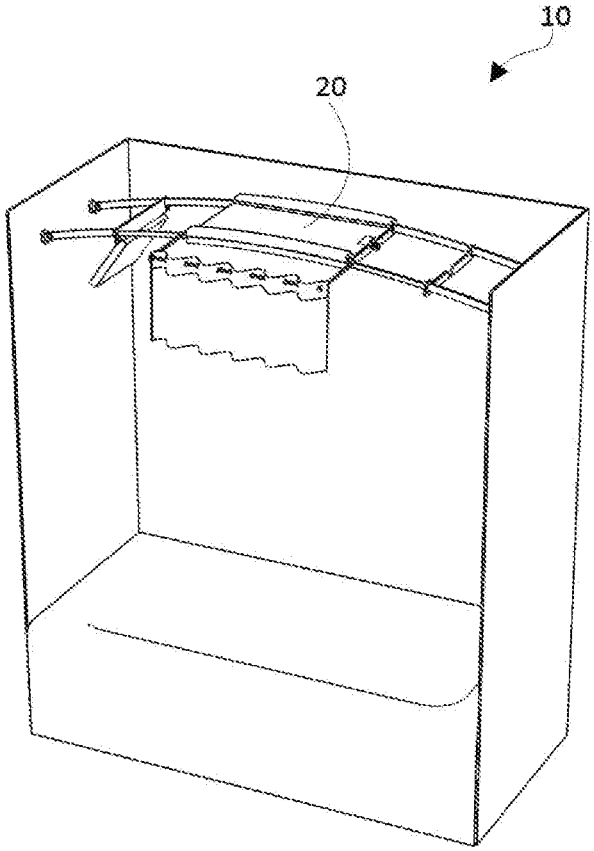
FIG. 14 is an exemplary perspective view of the showerhead shower system in situ in a full-size shower bath.
Figure 15:
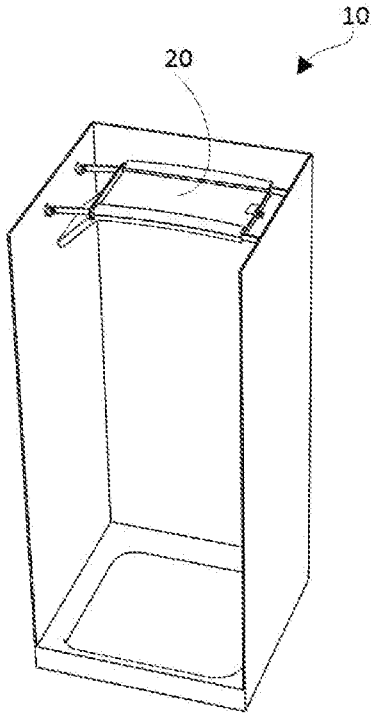
FIGS. 15 and 16 are exemplary perspective views of the showerhead shower system in situ in a shower stall.
Figure 16:
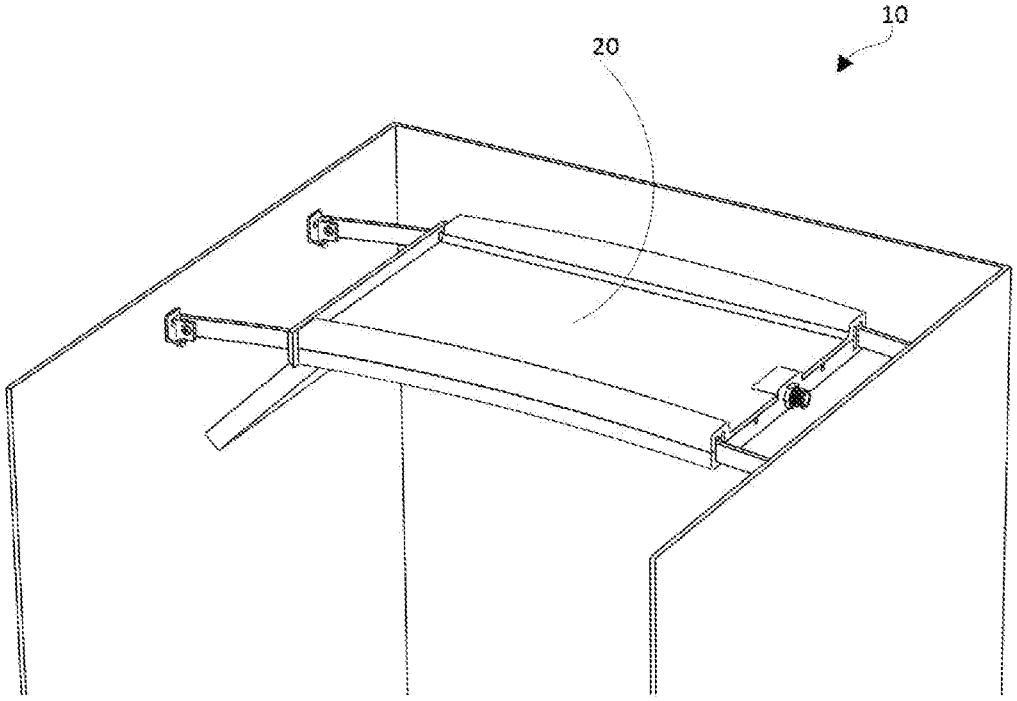
Figure 17:
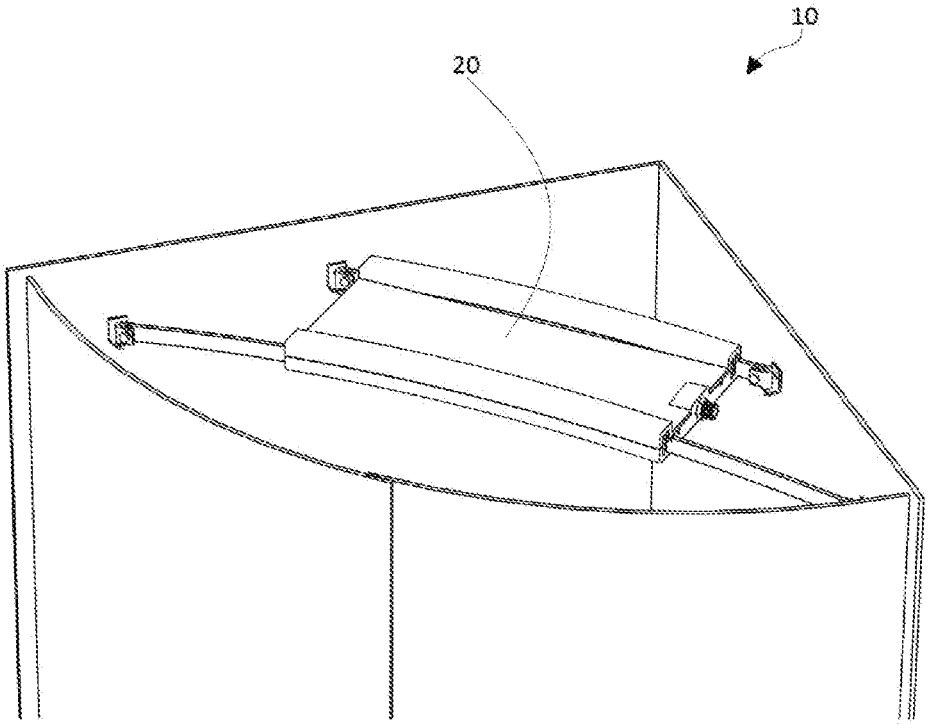
FIG. 17 is an exemplary perspective view of the showerhead shower system in situ in an enclosed corner shower stall, wherein the system is attached to the walls of the shower stall using angled mounting flanges.

In reference to FIG. 13, the expandable support members 300 may include integrated shower curtain rod supports 304 or separate supports that attach over the support members 300. Integrated shower curtain rod supports 304 are formed as a rectangular or approximately rectangular section of the expandable support member 300 and have a hinge 308 at the end nearest the showerhead 20. Such hinge 308 is typically a pressed barrel hinge. This allows the curtain rod support 304 to fit inside the support slide tracks 136 and 214, to slide in and out of the showerhead 20 in line with the support member 300, and to pivot out from the support member 300 once expanded from the showerhead 20. The free end of the shower curtain rod support 304 features a notch, with which a notch in the curtain rod mates in a lap joint.

Some embodiments have integrated shower curtain rod supports 304 on all support members 300, to accommodate all shower spaces, but other embodiments may have them only on one side of the Central Plane. For embodiments with integrated shower curtain rod supports 304 on only one side of the Central Plane, the showerhead system is "handed"—that is, the embodiment is intended either for shower spaces with plumbing on the right hand side or left hand side of the shower space.

Because the distance between expandable support members 300 is different from one end of the showerhead 20 to the other, individual members of a pair of shower curtain rod supports 304 on one side of the Central Plane have different lengths to allow the curtain to hang parallel to the long side of the showerhead 20.

The arched sides 506 of the showerhead 20 house the tracks 134, 136, 212 and 214 formed by the L-shaped pockets 132 and 210 along which the support members 300 slide. The curve of the arched support members 300 matches that of these arched features 506 in the showerhead 20 to allow the members 300 to expand forming an arch above the shower space, which adds a pleasing architectural feature as well as increased load bearing capacity.

The support member travel stop 310 is a cylindrical projection from the surface of the support member 300 that prevents it from escaping the showerhead 20. The travel stop 310 is of smaller diameter than the smallest outer dimension of the support members 300. When the support members slide along the support slide tracks 136 and 214 outward from the showerhead 20, the support member travel stops 310 ride in the travel stop tracks 134 and 212 of the L-shaped pockets 132 and 210 of the front piece 100 and back piece 200, respectively. Because the travel stop tracks 134 and 212 do not extend to the outer surface of the showerhead 20, when the support member 300 is withdrawn from the showerhead 20, the support member travel stop 310 contacts the outer surface and interferes with the motion. This keeps the support member 300 captive within the body of the showerhead 20.

The method of connection of the support member 300 to the surfaces of the shower space may take a wide variety of forms and is determined by one of ordinary skill in the art to suit the intended installation environment, achieve customer satisfaction and to comply with building codes, zoning restrictions, or other laws, rules or regulatory requirements.

Some embodiments attach to the walls of the shower space using surface-mounting flanges 312 on the outer ends of the support members 300. The flanges 312 have a flat base that fits against the mounting surface. The base of the mounting flange has one through-hole 313 that allows a fastener to pass through the vertical portion into the mounting surface. By using a single fastener, the surface-mount flange 312 can be rotated slightly, thereby accommodating some inaccuracy in the level and plumb of installation. Also, the single fastener design allows the mounting flange 312 to attach to surfaces that are not completely flat. Once connected to the expandable support arms 300, the flange 312 will no longer rotate.

Figure 12:
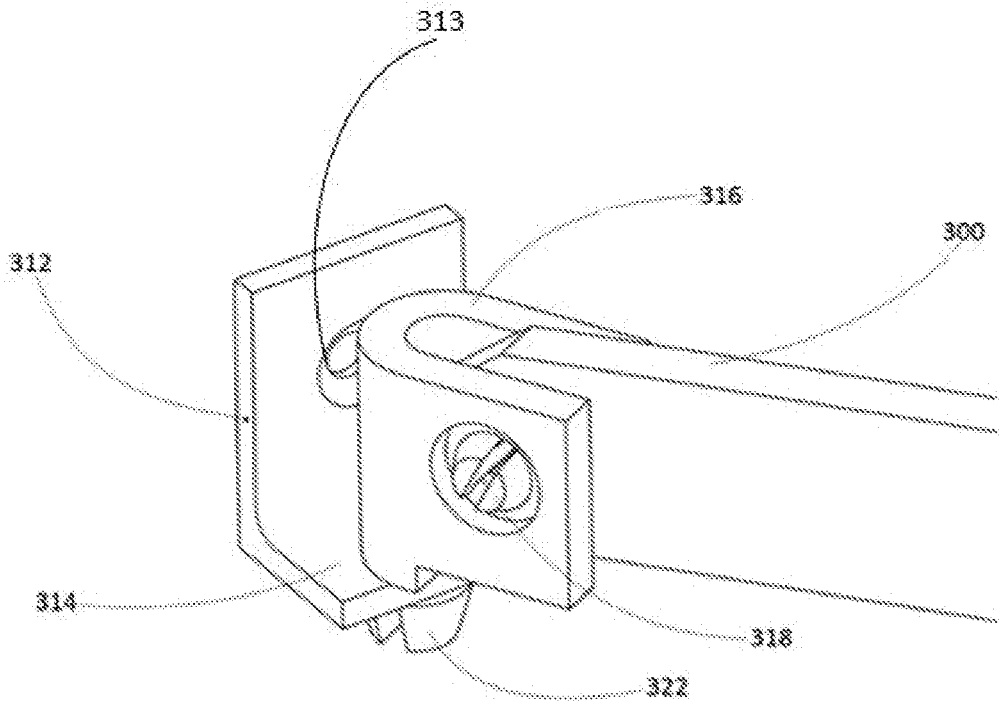
FIG. 12 is an exemplary view of the surface mounting flanges, showing connection with the expanding support member using a split-barrel pin.

Many different embodiments of mounting flange may be used with the showerhead system 10. One embodiment utilizes an L-shaped mounting flange 312 featuring a pivot platform 314 with a through hole for attaching a pivot arm 316. The hole in the pivot platform 314 receives a vertical, snap-fit, split-barrel pivot pin 322 protruding from the pivot arm 316. The pivot arm 316 has a U-shape and rests horizontally on the pivot platform 314, as shown in FIG. 12 thus rotating in the horizontal plane. The pivot arm 316 features a hole through both arms of the U-shape. These arms are pinned to the ends of the expandable support members 300 by a removable horizontal, snap-fit, split-barrel pivot pin 318 that passes through both these holes. The horizontal pivot pin 318 allows easy removal and re-attachment for installation purposes. Further, the end of the support arm may have a flared slot 320, extending below a through-hole that allows the split-barrel pivot pin to be installed in the mounting flange before the expandable support member 300 is pressed over the pivot pin 318. The sides of the pin 318 compress while passing through the flared slot 320 and expand into the through-hole. In such an embodiment, the pivot pin 318 may be removed by compressing the split end and pushing it backwards out of the through-hole.

The outer ends of the support members 300 are chamfered to allow clearance for the mounting flange 312 to pivot on the pivot pin. Allowing the mounting flanges to pivot in this way creates tolerance for mounting the showerhead to surfaces that are not square, plumb, and level, or for inapt installation.

Some embodiments are typically attached to the walls of the shower space using ordinary drywall anchors and screw fasteners. Alternative embodiments may use cam levers to press the expandable support members against the sides of the T-shaped pockets and simultaneously press them against the mounting surfaces of the shower space. However, a shortcoming of these embodiments is that the force of compression may not remain static, i.e., the addition of accessories or simply the passage of time could allow the supports to come loose from one or more mounting surfaces.

The Supply Line:

Liquid is supplied to the showerhead 20 through a supply line. The supply line connects the building plumbing or other liquid supply to the showerhead 20 at the liquid inlet 104. Typically, a ½" male NPT threaded adapter 108 is installed in the threaded liquid inlet 104 of the showerhead 20 and sealed with adhesive, plumbing tape, or by welding. Some embodiments affix the threaded adapter 108 by means of solvent welding. The supply line is then connected from the showerhead 20 to a diverter valve, installed to allow the user to select between different shower features.

The dimensions and specifications of the threaded adapter 108 and supply line are determined by one of ordinary skill in the art such that they are appropriate to the specific installation of the showerhead 20.

The Supply Line Support 400:

In reference to FIG. 1, the supply line support 400 connects to the showerhead 20 on the liquid inlet 104 side of the showerhead 20 by means of snap-fit cantilever 141 features. These features align with the receiving pockets 138 in the front part, as shown in FIGS. 1 and 6. In some embodiments, the supply line support 400 features rectangular mounting holes 402 that fit around the expandable support members 300 and slide along them, as shown in FIG. 1.

The supply line support 400 features a beveled, curved saddle 404 along its top edge, upon which the supply line rests. The position of the supply line support 400 is adjustable along the support members 300 or fixed by means of a notch in the support members 300. The supply line is installed such that it passes over and rests upon the saddle 404 of the supply line support 400.

Figure 11:
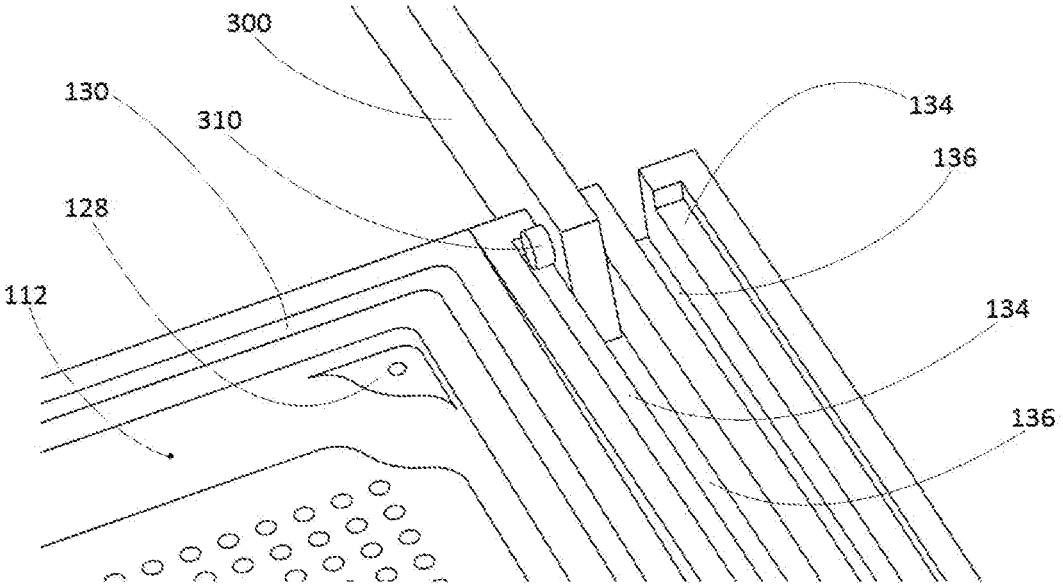
FIG. 11 is an exemplary view of the front part, showing the L-shaped pockets and support member travel stops with the expanding support members fully expanded.

Assembly:

To assemble the pieces of the preferred embodiment of the showerhead system 10, the expandable support members 300 are placed into the L-shaped pockets 132 of the front part such that the travel stops 310 rest in the travel stop track 134, as shown in FIG. 11. In some embodiments, the shower system 10 includes two pairs of support members 300, with first pair comprising a support member disposed on each side of the Central Plane, and second pair comprising a support member disposed next to the first pair on each side of the Central Plane. In some embodiments, when the travel stops 310 rest in the travel stop track 134, the pair of support members 300 corresponding to the travel stops 310 extend from the side of the showerhead 20 where the liquid inlet 104 is located. Mirroring the installed location of the expandable support members 300 improves stability and the overall aesthetics of the showerhead shower system 10.

In some embodiments, the front part 100 and back part 200 are joined using screw fasteners with countersunk heads, which pass from above the back part 200, through the back part 200, into the joining bosses 128 of the front part 100, as shown in FIG. 9.

In some embodiments, the mounting flanges 312 are joined to the expandable support members 300 using removable, snap-fit, split-barrel pivot pins 318, to allow easy removal and re-attachment.

Operation:

The showerhead system 10 is installed by: (1) expanding the support members 300 and fastening them appropriately to the surfaces of the shower space; (2) positioning the showerhead 20 as desired; and (3) connecting the liquid supply line to a pressurized liquid supply and turning on the supply. For embodiments including misting nozzles, the nozzles and tubing may be positioned and routed along the support members 300 as desired or at locations determined by one of ordinary skill in the art.

The showerhead system 10 can be installed at any desired height—up to and including positions at or near the ceiling above a typical shower enclosure. The force of the falling water can be set by adjusting the height of installation of the showerhead system 10.

Some embodiments may feature mounting flanges 312 with multiple through-holes, allowing the split-barrel pivot pins 318 to be easily removed and repositioned at varying heights. Tolerances, angles and materials used in those embodiments should allow the support members 300 to deflect sufficiently where relocating is needed.

When using the showerhead system 10, the pressurized liquid flows into the showerhead 20 through the liquid inlet 104 and is divided into liquid channels 114 that carry the liquid to atmospheric pressure dispersion chambers 112. In the dispersion chambers 112, the liquid impinges on dispersion bosses 126. The dispersion bosses 126 disperse the liquid across the chambers 112 such that the liquid exits the showerhead 20 through the dispersion grating 102 to fall on the shower occupant. In embodiments with misting nozzles, liquid from the liquid supply rail 110 passes out the liquid outlet 510 into the misting system tubing 515 through a fitting common to such systems. The liquid mist fills the shower space and falls on the shower occupant.

Production:

The design of the showerhead system 10 disclosed herein minimizes the number of steps to produce it and minimizes the number and complexity of steps to assemble it. In some embodiments, all of the features of the front part 100 are formed and finished by injection molding process except the threaded hole for the liquid inlet 104, which is formed my manual and/or machine process after molding. The dimensions and threading of the liquid inlet 104 can be determined at the time of manufacture by one of ordinary skill in the art to meet the needs of the market, customer satisfaction, regulatory requirements, or other requirements of the installation environment. Similarly, the features of the back part 200, the expandable support members 300, and supply line support 400, are formed and finished by injection molding, but without further manual and/or machine processing.

Sliding Video Display Carrier 500

In some embodiments, the showerhead system disclosed herein includes a sliding video display carrier 500, which is constructed of translucent material such as acrylic plastic. In reference to FIG. 5, the video display carrier 500 has a slot on one side and a rectangular pocket 508 formed within to accommodate a video tablet. In some embodiments, a reusable clear plastic waterproof sleeve is provided to enclose the video tablet. Such waterproof protectors are readily available on the commercial market. For tablets with ingress Protection ("IP") rating, the sleeve is typically not needed. In some embodiments, the video display carrier 500 is suspended from and slides along the expandable support members 300. In some other embodiments, the video display carrier 500 is positively located by seating its hangers into accessory notches 302 in the expandable support members 300, as shown in FIG. 13.

In reference to FIG. 5, the video carrier 500 can be detached from the support members 300 by lifting up and rotating the carrier slightly to allow it to pass between the expandable support members 300. The video carrier 500 should not be loaded or unloaded while the shower is in operation.

Shower Curtain 502 and Rod 504

In some embodiments, the showerhead system disclosed herein includes a shower curtain rod 504 for supporting a shower curtain 502, as shown in FIG. 1, In some embodiments, the rod 504 is dimensioned to fit diagonally across the showerhead 20 when packed in retail packaging. The shower curtain 502 is constructed of appropriate material, such as cloth, plastic, or similar material.

Sliding Shower Caddy/Carrier

In some embodiments, the showerhead system disclosed herein includes a box-shaped caddy which is disposed on and supported by the expandable support members 300. The caddy attaches and detaches from the support members in similar fashion to the video display carrier 500.

Misting System

As described above, the misting system 513 attaches to the showerhead 20 by means of a threaded, cylindrical liquid outlet 510 on the far side of the showerhead 20 opposite the liquid inlet 104. The components for the accessory, misting system 513 are readily available on the open market.

Alternative Embodiments

The internal fluid channels can be replaced with tubing and misting nozzles like those outside the showerhead. This provides a variety of possible acoustic effects and spray coverage patterns.

Shower Space Applications

The showerhead system disclosed herein are compatible with a variety of shower space settings, examples of which are shown in FIGS. 14-17.

What is claimed is:

1. A showerhead assembly for dispersing liquid, comprising, a back part;

a front part coupled to the back part to form a plurality of dispersion chambers between the front part and the back part, wherein the dispersion chambers each include a dispersion grating formed on one surface thereof;

an inlet boss disposed between the front part and back part for connecting a liquid supply line;

a liquid supply rail disposed between the front part and the back part and connected to the inlet boss, the liquid supply rail comprising a plurality of channels leading to the corresponding dispersion chambers, whereby the liquid received from the inlet boss flows through the channels to enter the dispersion chambers; and a plurality of support members slidably coupled to the front part such that the support members can slide within a space formed between the front part and the back part.

2. The showerhead assembly of claim 1, further comprising a diffuser connected to the inlet boss to divide the liquid received therefrom into the channels.

3. The showerhead assembly of claim 2, wherein the back part comprises a cover for the diffuser wherein the cover is concaved outward from the front part to form a substantially elliptical cross-section in proximity to the inlet boss.

4. The showerhead assembly of claim 1, wherein the back part comprises a plurality of covers to seal the channels, thereby forming substantially round pipes within the channels.

5. The showerhead assembly of claim 1, wherein the channels have substantially, equal internal diameters and substantially equal lengths in the paths thereof routing to the corresponding dispersion chambers.

6. The showerhead assembly of claim 5, wherein the channels include a plurality of turns in the paths thereof.

7. The showerhead assembly of claim 1, further comprising a dispersion boss in proximity to the exit of the channel in at least one of the chambers, wherein the dispersion boss is of a fan pattern.

8. The showerhead assembly of claim 1, wherein the dispersion grating of at least one of the dispersion chambers is graded toward the liquid supply rail.

9. The showerhead assembly of claim 1, wherein the front part comprises a plurality of protrusions in proximity to the dispersion chambers for fastening to the back part.

10. The showerhead assembly of claim 1, wherein the front part comprises a groove circumscribing the plurality of the dispersion chambers for receiving seal to join with the back part.

11. The showerhead assembly of claim 1, wherein:

the front part and the back part each comprise four integrated L-shaped pockets, with two of the L-shaped pockets formed in parallel along one side and the other two of the L-shaped pockets formed in parallel along the opposite side; and the four L-shaped pockets of the front part are joined with the four corresponding L-shaped pockets of the back part to form four T-shaped pockets for receiving the support members such that the support members can slide along therein.

12. The showerhead assembly of claim 11, wherein:

the support members each include a cylindrical protrusion disposed at the proximal end thereof with respect to the T-shaped pockets; and the T-shaped pockets each include a bump at the ends thereof to prevent the cylindrical projection from sliding out therefrom.

13. The showerhead assembly of claim 1, wherein the back part comprises a plurality of chamber covers protruding from the inner surface of the back part to seal the corresponding dispersion chambers.

14. The showerhead assembly of claim 1, wherein the hack part comprises a notch for fitting against the inlet boss.

15. The showerhead assembly of claim 1, wherein each of the support members is an arched rectangular bar and the front part and the back part are bended to form an arch for housing the support members.

16. The showerhead assembly of claim 1, further comprising:

a liquid supply line for receiving liquid; and a liquid supply line support including a notch for the liquid supply n.

17. The showerhead assembly of claim 16, wherein:

the liquid supply line support includes a plurality of snap-fit cantilevers; and the front part includes a plurality of pockets formed therein in proximity to the inlet boss and having a draft angle for receiving the corresponding snap-fit cantilevers.

18. The showerhead assembly of claim 16, wherein the liquid supply line support includes a hole formed at each end thereof for one of the support member to pass through.

19. The showerhead assembly of claim 1, further comprising a shower curtain rod for supporting a shower curtain, wherein the shower curtain rod includes two arms that are connected to the corresponding support members.

20. The showerhead assembly of claim 19, wherein the two arms of the shower curtain rod are each connected to the corresponding support members through a pressed barrel hinge.

21. The showerhead assembly of claim 19, wherein the shower curtain rod is integrated with the corresponding support members.

22. The showerhead assembly of claim 1, further comprising a mounting flange on the distal end of the support members, wherein the mounting flange comprises a fastening through hole allowing fastening of the mounting flange to a surface in a shower space.

23. The showerhead assembly of claim 22, wherein:

the mounting flange comprises a horizontal platform with a through hole for receiving a U-shape pivot, the U-shape pivot having a hole piercing through both arms of the U-shape; and the U-shape pivot is pinned to the distal end of the support member by a pivot pin pass through the hole.

24. The showerhead assembly of claim 1, wherein the liquid supply rail comprises a channel leading to a hose fitting for connecting to a misting system.

25. The showerhead assembly of claim 1 further comprising:

a display carrier slidably and detachably coupled to at least one of the support members, wherein the display carrier comprises a rectangular housing with a slot on one side for receiving a tablet.

26. The showerhead assembly of claim 1, further comprising a box-shaped caddy detachably coupled to and supported by at least one of the support members.

* * * * *